United States Patent [19]

O'Brien et al.

[11] 4,003,620

[45] Jan. 18, 1977

[54] PRESSURE COMPENSATED MARINE ELECTRICAL CABLE APPARATUS

[75] Inventors: Donald G. O'Brien, Wayland; Edward R. Walker, Natick, both of Mass.

[73] Assignee: D. G. O'Brien, Inc., Framingham, Mass.

[22] Filed: Oct. 12, 1970

[21] Appl. No.: 79,781

[52] U.S. Cl. ..... 339/29 R; 174/22 R; 339/94 R; 339/117 R

[51] Int. Cl.[2] ..... H01R 13/52

[58] Field of Search ..... 174/88 R, 70 S, 22 R, 174/20, 15 C, 25 R, 25 C, 19, 21 R, 24, 47, 68, 76; 339/15 R, 16 R, 115 R, 112 R, 28, 29, 94, 117

[56] References Cited

UNITED STATES PATENTS

| | | | |
|---|---|---|---|
| 3,158,680 | 11/1964 | Lovitt et al. | 174/88 R |
| 3,493,902 | 2/1970 | Watlington | 174/70 S X |
| 3,621,447 | 11/1971 | Taylor et al. | 174/24 R X |

*Primary Examiner*—Joseph H. McGlynn
*Attorney, Agent, or Firm*—Kenway & Jenney

[57] ABSTRACT

Marine electrical cable apparatus has a flexible cable jacket loosely containing cable conductors and filled with a relatively incompressible fluid such as oil. The jacket flexes with changes in the environmental pressure to transmit that pressure to the inner fluid and thereby maintain minimal pressure differential across the jacket walls. Terminations at each end of the cable seal the jacket interior from the environment and feed the cable conductors from within the jacket out for connection with further electrical equipment.

16 Claims, 2 Drawing Figures

INVENTORS
DONALD G. O'BRIEN
EDWARD R. WALKER
BY
Kenway, Jenney & Hildreth
ATTORNEYS

PRESSURE COMPENSATED MARINE ELECTRICAL CABLE APPARATUS

BACKGROUND

This invention relates to electrical cable equipment that is to be subjected to high environmental pressures. In particular, the invention provides electrical cable equipment in which the cable components, including at least the cable jacket and cable conductors, receive only minimal mechanical stresses when in a deep underwater or other high-pressure environment.

The invention achieves this objective with a construction that essentially equalizes the pressure within the cable outer jacket and the environmental pressure.

Cable equipment constructed in accordance with the invention can be used, by way of example, in unpressurized compartments of ships or submarines, and to interconnect submerged vessels or equipment with other like equipment or with surface equipment.

Undersea electrical cables constructed in accordance with the prior art typically have outer casings constructed to withstand the large pressures encountered deep below the earth's surface. For example, cables for interconnecting compartments of a submarine frequently employ a "water-block" construction in which individually insulated conductors are bundled together within a heavy armored sheath that withstands the hydrostatic pressures. However, when these prior cables are subjected to large changes in environmental pressure, such as the pressure change between the ocean surface and the ocean floor, or when they are subjected to repeated pressure-cycling or mechanical flexing, the pressure-tight construction is likely to break up internally causing electrical failure. Also, these prior constructions for marine cables are generally relatively complex and costly, particularly if small quantities are involved. A further problem with prior art marine cables is that they often must be handled with care, such as during spooling or winching, to ensure that the internal conductors are not bent too sharply or too quickly, or otherwise damaged.

Accordingly, an object of this invention is to provide electrical cable equipment for use in deep underwater and like high-pressure environments without subjecting the components thereof to large pressure differentials or excessive mechanical stresses.

Another object of the invention is to provide cable equipment of the above character that subjects the cable jacket and the electrical conductors therein to only relatively small changes in mechanical stress and/or flexure when the environmental pressure of the cable changes considerably or repeatedly.

It is also an object of the invention to provide a cable connector for connection with an electrical cable having the interior thereof sealed from the environmental fluid, but at essentially the same pressure.

Another object of the invention is to provide cable equipment of the above character that is relatively low in cost and which withstands rough handling.

Other objects of the invention will in part be obvious and will in part appear hereinafter.

SUMMARY OF THE INVENTION

A marine cable constructed in accordance with the invention has individually insulated cable conductors disposed loosely within a fluid-tight outer sheath or jacket that is flexible in the sense that it deforms radially to minimize the pressure differential across its walls, as well as being longitudinally flexible and capable of sharp bending. Oil or other relatively incompressible and electrically insulative fluid fills the interior of the jacket. The radial flexure of the jacket subjects the fluid to the outer, environmental pressure so that there is little pressure differential across the walls of the jacket. The connectors or other terminations at the cable ends receive the cable sheath and cable conductors at an inner compartment that is sealed from the environment and is filled with the jacket-filling oil or other liquid.

With this cable construction, the pressure within the cable jacket is nearly equal to the environmental pressure at all times, and the jacket is subjected only to minimal pressure differential, even when the cable is moved between the ocean surface and the ocean floor. Further, the relatively loose disposition of the cable conductors within the jacket allows them to flex essentially independently of the cable jacket, thereby further minimizing the introduction of mechanical strains as the cable is subjected to different environmental pressures, or handled and otherwise flexed.

Cable connectors for terminating the oil-filled jacket have an outer housing with a pressure-proof bulkhead through which connector pins pass with fluid-tight seals for enabling external connection to the cable conductors. The connector housing is fitted with a closable orifice through which the jacket-filling liquid is introduced or removed.

The invention accordingly comprises the features of construction, combination of elements, and arrangement of parts exemplified in the construction hereinafter set forth, and the scope of the invention is indicated in the claims.

BRIEF DESCRIPTION OF DRAWINGS

For a fuller understanding of the nature and objects of the invention, reference should be had to the following detailed description taken in connection with the accompanying drawings, in which.

DESCRIPTION OF ILLUSTRATED EMBODIMENT

Figures 1, 2:
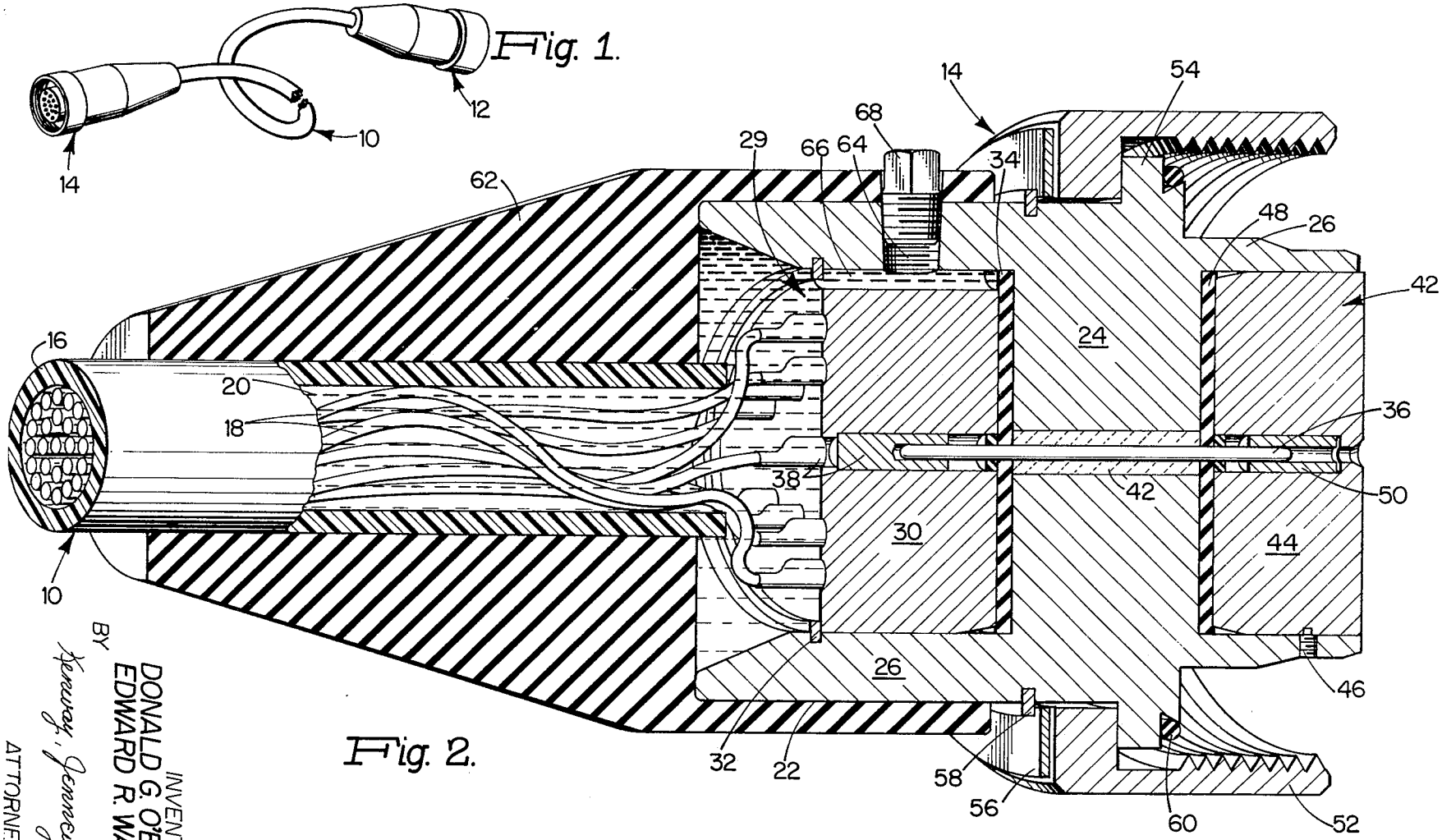
FIG. 1 shows electrical cable equipment embodying the invention.
FIG. 2 is an enlarged sideview, partially broken away, of an electrical cable and one connector constructed in accordance with the invention.

The cable assembly in FIG. 1 includes a cable 10 terminated at one end with a cable plug connector 12 and at the other end with a jack or socket connector 14. As further shown in FIG. 2, the cable 10 has a hollow tubular outer jacket 16 that encloses and loosely supports a bundle of individually insulated cable conductors 18. An electrically insulative and relatively incompressible fluid such as oil 20 fills the cable jacket 16, and the connectors 12 and 14 seal the jacket interior from the environment, thereby sealing the oil 20 within the jacket.

For use in an environment at sea level pressure or greater, the oil typically is sealed within the cable at sea level pressure. Hence, the pressure outside the cable is never significantly less than this initial oil pressure within it, but rather is usually greater.

With this construction, the jacket 16 flexes radially in accordance with the environmental pressure outside it and transmits this pressure to the oil 20. Hence the oil is under essentially the same pressure as the environment, and no significant pressure differential develops across the walls of the jacket or across the connector walls that receive the cable. Accordingly, the cable assembly is free of mechanical strains due to the high pressures of deep sea or like environments.

Further, the oil 20 exerts the environmental pressure equally to all sides of the cable conductors 18. Further, it even flows into the interstices within the conductors, e.g. between the conductive strands and insulating jacket and between the strands themselves. This equal-pressure condition subjects the conductors to minimal mechanical stresses. Also, the cable conductors 18 are loosely and freely arranged within the cable jacket 16. Typically the conductors 18 are measurably longer than the cable jacket 16 and are formed in a loose helical bundle prior to insertion in the jacket 16. In any event, the conductors 18 are not connected to the jacket 16 between the cable terminations such as are formed by connectors 12 or 14. Accordingly, deformation of the cable jacket 16 in response to different environmental pressures and due to other flexing or coiling of the cable is transmitted, at most, only loosely to the conductors 18 so that they are not unduly stressed during use in even the most adverse pressure environments.

These features of the cable 10 and its terminations minimize the likelihood that the cable jacket or the conductors 18 are damaged by adverse environmental conditions, even in the presence of extreme pressure, flexure or cable vibration. As a result, the cable assembly provided by the invention is highly reliable.

Considering the construction of the illustrated cable assembly in further detail, the cable jacket 16 is flexible and of fluid-impervious corrosion-resistant material. By way of example, it can be made of synthetic resin material; a preferred material is the synthetic polymer sold under the tradename Tygon, marketed by U.S. Stoneware Company. The cable conductors 18 are of conventional construction and materials selected according to the electrical and other requirements for the cable.

The illustrated cable socket connector 14 has a generally cylindrical housing 22, typically of rigid material such as stainless steel, forming a bulkhead 24 and an inner tubular wall 26 and an outer tubular wall 28. The tubular walls 26 and 28 extend in opposite directions from the bulkhead 24 along a common axis aligned with the cable at its juncture with the connector 14. (The terms "inner" and "outer" are used here with reference to parts of the cable-terminating connectors disposed proximal to and remote from the cable, respectively.) The inner tubular wall 26 and bulkhead 24 of the connector housing form an inner compartment 29 in which a connector block 30 is seated and secured by means of a retaining ring 32 seated in a slot recessing the inner surface of the wall 26. An insulating disk 34 is preferably provided sandwiched between the connector block 30 and the bulkhead 24.

The connector block 30, of insulating material such as diallyl phthalate, is bored along the length thereof to accommodate connector pins 36. More particularly, the illustrated tubular wall 26 extends axially from the bulkhead 24 beyond the connector block 30 to form an inner section of the compartment 29. In this inner compartment section, each cable conductor 18 is connected to a socket contact 38 that extends into a bore in the connector block 30. Each contact 38 has a socket end that telescopically fits over the inner end of each conductor pin 36.

Each connector pin 36 extends outwardly from the socket contact 38 with which it is connected, passes through the insulating disk 34, and passes through the bulkhead 24 within a glass-to-metal seal 42 that mechanically secures the pin in place, insulates it from the bulkhead 24, and provides a fluid-tight seal between the pin and the bulkhead. Each connector pin 36 extends beyond the outer side of the bulkhead to within an outer compartment 42 formed by the connector housing bulkhead and outer wall 28. An outer connector block 44, also of insulative material like the inner block 30, is seated in this outer compartment and secured in place with one or more set-screws 46 threaded through the outer wall 28. The outer block 44 is bored to receive the ends of the connector pins and to carry sleeve-like socket contacts 50, each of which seats over the outer end of one connector pin 36 making electrical contact therewith.

The contacts of another connector (not shown) that mates with the connector 14 electrically connects to each connector pin 36 by means of the socket contact 50. The connector 14 engages this further connector by means of a conventional internally-threaded coupling ring 52 retained on the outside of the connector housing 22 between an outer shoulder 54 on the housing and a back-up washer 56 held in place by means of an outer securing ring 58 seated in a slot recessing the connector housing as shown. The connector housing further carries an O-ring 60 adjacent to the base of the outer tubular wall 28 for effecting a fluid-tight seal with this further connector element. As also shown, an insulating disk 48 preferably is seated between the outer connector block 42 and the bulkhead 24.

With further reference to FIG. 2, the illustrated cable 10 extends into the inner section of the connector inner compartment 29. A boot 62, molded of rubber or other flexible material that seals tightly over the end of the cable jacket adjacent to the connector and over the outside of the connector inner wall 26 as shown, secures the cable jacket to the connector housing. In an alternative construction not shown, there is no boot 62. Instead, the cable-receiving end of connector housing 22 has a nipple-like tube of smaller diameter than wall 26 sealed to this wall and extending toward the cable 10. The cable jacket 16 telescopically fits over this tube and is clamped to it.

The cable assembly is filled with the oil 20 or other incompressible and electrically insulating fluid through an orifice 64 through the connector inner wall 26 and the overlying sleeve of the boot 62. The illustrated connector block 30 has a groove 66 along the length thereof beneath the inner end of the orifice 64 and communicating therewith for feeding the oil from the orifice into the inner section of compartment 29 and the interior of the cable jacket 16. The oil thus fed into the cable assembly fills the jacket entirely and fills the unoccupied portion of the compartment 29 and the groove 66, so that all the void spaces within the cable assembly on the cable side of the insulating disk 34 and the connector block 30 are filled with the oil 20. A threaded plug 68 forms a removable and replaceable fluid-tight closure for the orifice.

The termination at the other end of the cable 10, illustrated as the plug connector 12, can be constructed in the same manner as the socket or receptacle connector 14 (except with pin contacts on the outer end thereof) to seal the end of the cable and feed the cable conductors out for further connection. It is preferable that the plug connector 12 also have an orifice corresponding to the orifice 64 in the receptacle connector 14, so that during the filling of the cable assembly with oil, one orifice can be opened for venting while the oil is delivered at the orifice at the other end of the cable assembly.

The cable assembly constructed in the foregoing manner thus has the entire length of the cable jacket and the communicating compartments in the terminating connectors filled with insulating and incompressible oil or other liquid. The flexibility of the cable jacket allows it to deform in response to changes in the external, environmental pressure so that no significant pressure differential develops across either the jacket wall, the boot 62 at the juncture of the cable and the terminating connector, or the portion of the terminating connector fitted therewith, e.g., the connector housing inner wall 26. When the outer end of the cable connector 14, for example, is connected with an electrical device having a pressure other than the environmental pressure, then the differential pressure develops across the connector bulkhead 24 and the glass-to-metal seals 42 through which the connector pins pass. Hence the bulkhead functions as a pressure barrier. With this arrangement, the cable 10 and the portions of the terminating connectors engaged with it do not need to have a heavy construction for withstanding large pressures such as are encountered in deep undersea environments. Further, the cable conductors 18 receive minimal flexing and stress due to different environmental pressures as well as from flexing of the cable. As a result of these advantages, the present cable assembly can be fabricated at relatively low cost and yet provides reliable operation for prolonged periods of time and repeated pressure fluctuations.

It will thus be seen that the invention attains the objects set forth above, among those made apparent from the preceding description, by providing an electrical cable assembly having a flexible, loosely-fitting, conductor-enclosing jacket filled with liquid and having cable end terminations sealing the jacket interior from the environment. Since certain changes may be made in the above construction without departing from the scope of this invention, it is intended that all matter contained in the above description or shown in the accompanying drawing shall be interpreted as illustrative rather than in a limiting sense.

It is also to be understood that the following claims are intended to cover all of the generic and specific features of the invention herein described, and all statements of the scope of the invention which, as a matter of language, might be said to fall therebetween.

Having described the invention, what is claimed as new and secured by Letters Patent is:

1. Pressure compensated electrical cable apparatus comprising

A. a liquid-impervious hollow tubular cable jacket extending between first and second ends thereof and flexing radially in accordance with changes in the environmental pressure to diminish the pressure differential across the walls thereof, B. at least one individually-insulated electrical cable conductor within said jacket extending between said first and second ends, C. first and second cable terminations, each of which is secured to said cable jacket at the same-numbered end thereof with a liquid-impervious and pressure-withstanding seal between the environment and said jacket interior, and further has an electrical connector conductor connected with said cable conductor within said jacket, and D. electrically insulative and relatively incompressible fluid filling the interior of said cable jacket.

2. Cable apparatus as defined in claim 1 in which said conductor is loosely disposed within said jacket for movement independently thereof.

3. Cable apparatus as defined in claim 1 in which at least said first cable termination has an inner compartment in liquid communication with the interior of said cable jacket and filled with said fluid.

4. Cable apparatus as defined in claim 3 in which said first cable termination includes A. an externally accessible opening between the environment and said inner compartment thereof for the passage of said fluid between the environment and said compartment, and B. a nondestructably removable and replaceable closure means for closing said opening with a fluid-tight seal.

5. Cable apparatus as defined in claim 3 wherein said first termination comprises A. a housing shell forming said inner compartment thereof and having a pressure-secure bulkhead adjacent the end of said inner compartment remote from the juncture of said termination with said cable, B. a connector block seated in said inner compartment, and C. at least one connector conductor connected through said block with said cable conductor and passing from within said block through said bulkhead with a fluid-tight and pressure-secure seal therewith.

6. Cable apparatus as defined in claim 5

A. wherein said housing shell has an inner tubular wall extending along the axis of connection therewith with said cable from said bulkhead and forming therein said inner compartment, B. further comprising fluid-tight juncture means fitting with mechanically secure fluit-tight seals over said first end of said cable jacket and over said housing shell inner wall, C. further comprising means forming an externally accessible orifice through said inner tubular wall communicating between the environment and said inner compartment for the passage of said fluid therebetween, and D. further comprising nondestructably removable and replaceable closure means for closing said orifice with a fluid-tight seal.

7. Marine electrical cable apparatus for use in high pressure environments and characterized by resistance to failure due to environmental pressure cycling in which a cable of at least one insulated conductor extends between and interconnects cable terminations at each end thereof, said apparatus having the improvement comprising A. a hollow flexible fluid-impervious tubular outer jacket on said cable enclosing said conductor and flexing radially in response to a change in the environmental pressure to diminish the pressure differential across the walls thereof, B. means coupling each cable termination to an end of said jacket with a fluid-tight seal, C. bulkhead means in each cable termination communicating on one side thereof with the pressure within said jacket and on the other side with the ambient pressure of the cable environment and forming a pressure-secure barrier therebetween, and D. an electrically-insulative and relatively incompressible liquid filling, with the one or more conductors of said cable apparatus, the interior of said cable jacket, said liquid receiving a pressure corresponding to the pressure of the cable apparatus environment by virtue of the flexure of said jacket.

8. Cable apparatus according to claim 7 further characterized in that said cable jacket loosely encloses said conductor and is free of connection to said conductor along the length thereof between said terminations.

9. Cable apparatus as defined in claim 7 in which said bulkhead means withstands pressure differentials equivalent to the pressure change between the ocean surface and the ocean floor.

10. Cable apparatus as defined in claim 7 in which the improvement further comprises means forming in each cable termination a compartment between said bulkhead means thereof and the interior of said jacket, said compartment being in fluid communication with the interior of said jacket and being filled with said liquid.

11. A deep submergence electrical assembly comprising:

a pair of spaced-apart connectors;

a flexible tube sealably connected at each end to a respective connector;

at least one wire extending through the tube between said connectors; one of the connectors includes a socket housing which has an outer end;

said outer end having means for sealably receiving the base end portion of a high-pressure electrical fitting; and the tube and socket housing being in communication with one another and being filled with an electrical insulating liquid.

12. A deep submergence electrical cable assembly for connection to the exterior of a deep submersible comprising:

a pair of spaced-apart connectors which are capable of withstanding the pressure differential between the submersible and the ambient ocean environment;

a flexible tube sealably connected at each end to a respective connector;

at least one wire extending through the tube between said connectors;

the flexible tube being filled with an electrical insulating liquid in communication with the connectors;

each of the connectors sealing the respective end of the tube;

a high-pressure feedthrough terminal plug disposed through each respective connector for withstanding the pressure differential between the submersible and the ambient ocean environment; and said wire being connected between the terminals of the plugs.

13. A deep submergence electrical cable assembly as claimed in claim 12 wherein:

the flexible tube is constructed of synthetic resin material; and one of the connectors has a fill hole and the other connector has a vent hole for said liquid.

14. A deep submergence electrical cable assembly for connection to the exterior of a deep submersible comprising:

a pair of spaced-apart connectors;

a flexible tube sealably connected at each end to a respective connector;

at least one wire extending through the tube between said connectors;

at least one of the connectors including a pressure bulkhead having one side adapted for sealable connection to the submersible;

said pressure bulkhead being capable of withstanding the pressure differential between the submersible and the ambient ocean environment;

said pressure bulkhead having an aperture which extends between its faces;

a high-pressure metallic feed through terminal plug sealably secured within said aperture for withstanding the pressure differential between the submersible and the ambient ocean environment;

one end of the wire being connected to the terminal of the plug; and the flexible tube and the connectors being filled with an electrical insulating liquid.

15. A deep submergence electrical assembly as claimed in claim 14 wherein:

an O-ring is recessed in said one side of the pressure bulkhead for providing the sealable connection.

16. A submersible electrical cable assembly for use in high pressure environments, said assembly comprising:

a pair of spaced-apart connectors;

a flexible tube sealably connected at each end to a respective connector;

at least one wire extending through the tube between said connectors;

the flexible tube being filled with an electrical insulating liquid in communication with the connectors;

said tube transferring the high environmental pressure of the submerged cable to said liquid to equalize the pressure differential outside the cable and in the cable interior;

a high-pressure feed through terminal conductor disposed through each respective connector; and said wire being connected between the terminal conductors of the connectors.

* * * * *

UNITED STATES PATENT AND TRADEMARK OFFICE

CERTIFICATE OF CORRECTION

PATENT NO. : 4,003,620
DATED : January 18, 1977
INVENTOR(S) : Donald G. O'Brien and Edward R. Walker It is certified that error appears in the above-identified patent and that said Letters Patent are hereby corrected as shown below:

Column 6, line 44, change "fluit" to --fluid--.

Signed and Sealed this

*Twenty-seventh* Day of *December 1977*

[SEAL]

*Attest:*

RUTH C. MASON
*Attesting Officer*

LUTRELLE F. PARKER
*Acting Commissioner of Patents and Trademarks*